US007967588B2

(12) United States Patent
Green et al.

(10) Patent No.: US 7,967,588 B2
(45) Date of Patent: Jun. 28, 2011

(54) FINE FIBER ELECTRO-SPINNING EQUIPMENT, FILTER MEDIA SYSTEMS AND METHODS

(75) Inventors: Thomas B. Green, Liberty Township, OH (US); Scotty L. King, Hamilton, OH (US); Lei Li, Cincinnati, OH (US)

(73) Assignee: Clarcor Inc., Franklin, TN (US)

( * ) Notice: Subject to any disclaimer, the term of this patent is extended or adjusted under 35 U.S.C. 154(b) by 182 days.

(21) Appl. No.: 11/942,937

(22) Filed: Nov. 20, 2007

(65) Prior Publication Data

US 2009/0126333 A1 May 21, 2009

(51) Int. Cl.
*D01H 4/00* (2006.01)

(52) U.S. Cl. ..... 425/83.1; 425/174.8 E; 425/174.8 R

(58) Field of Classification Search ..... 425/174.8 E, 425/174.8 R, 83.1
See application file for complete search history.

(56) References Cited

U.S. PATENT DOCUMENTS

| | | | | |
|---|---|---|---|---|
| 1,975,504 | A | 10/1934 | Formhals | |
| 3,994,258 | A | 11/1976 | Simm | |
| 4,069,026 | A | 1/1978 | Simm et al. | |
| 4,143,196 | A * | 3/1979 | Simm et al. | 428/212 |
| 4,144,553 | A | 3/1979 | Schmidt et al. | |
| 4,230,650 | A | 10/1980 | Guignard | |
| 4,287,139 | A | 9/1981 | Guignard | |
| 4,650,506 | A | 3/1987 | Barris et al. | |
| 4,759,782 | A | 7/1988 | Miller et al. | |
| 5,672,399 | A | 9/1997 | Kahlbaugh et al. | |
| 6,171,684 | B1 | 1/2001 | Kahlbaugh et al. | |
| 6,604,925 | B1 | 8/2003 | Dubson | |
| 6,641,773 | B2 | 11/2003 | Kleinmeyer et al. | |
| 6,673,136 | B2 | 1/2004 | Gillingham et al. | |
| 6,743,273 | B2 | 6/2004 | Chung et al. | |
| 7,029,620 | B2 | 4/2006 | Gordon et al. | |
| 7,086,846 | B2 | 8/2006 | Kleinmeyer et al. | |
| 7,134,857 | B2 | 11/2006 | Andrady et al. | |
| 7,754,123 | B2 | 7/2010 | Verdegan et al. | |
| 2006/0290031 | A1 | 12/2006 | Jirsak et al. | |
| 2007/0021021 | A1 | 1/2007 | Verdegan et al. | |
| 2007/0163217 | A1 | 7/2007 | Frey et al. | |
| 2008/0017038 | A1 | 1/2008 | Wu | |

FOREIGN PATENT DOCUMENTS

| | | |
|---|---|---|
| DE | 101 36 255 A1 | 2/2003 |
| EP | 0 162 645 A1 | 11/1985 |
| EP | 1 059 106 A2 | 12/2000 |
| GB | 1 346 231 | 2/1974 |
| GB | 1 484 584 | 9/1977 |

(Continued)

OTHER PUBLICATIONS

Keskato, Nanofiber Electrospinning Unit, pages from website, date last visited May 30, 2007, 4 pages, http://www.keskato.co.jp/english/neu/index/html.

(Continued)

*Primary Examiner* — Khanh Nguyen
*Assistant Examiner* — John Blades
(74) *Attorney, Agent, or Firm* — Reinhart Boerner Van Deuren P.C.

(57) ABSTRACT

Electrostatic fine fiber generation equipment such as for forming nano-fibers from polymer solution is provided. The fine fiber generation equipment includes a strand that may take the form of a stainless steel beaded chain. The beaded chain can be an endless chain entrained upon two guide wheels and driven about an endless path perpendicularly relative to the collection media.

16 Claims, 10 Drawing Sheets

FOREIGN PATENT DOCUMENTS

| | | | |
|---|---|---|---|
| WO | WO 03/016601 | A1 | 2/2003 |
| WO | WO 2005/024101 | A1 | 3/2005 |
| WO | WO 2005/090653 | A1 | 9/2005 |
| WO | WO 2006/108363 | A2 | 10/2006 |
| WO | WO 2006/108363 | A3 | 10/2006 |
| WO | WO 2006/108364 | A1 | 10/2006 |
| WO | WO 2006/131081 | A1 | 12/2006 |
| WO | WO 2007/054039 | A1 | 5/2007 |
| WO | WO 2007/054040 | A2 | 5/2007 |
| WO | WO 2008/028428 | A1 | 3/2008 |
| WO | WO 2009/010020 | A2 | 1/2009 |

OTHER PUBLICATIONS

Yuris Dzenis, Spinning Continuous Fibers for Nanotechnology, pages downloaded from website, downloaded from www.sciencemag.org on Jun. 6, 2007, 3 pages, pp. 1917-1919, www.sciencemag.org Science vol. 304 Jun. 25, 2004.

A.L. Yarin et al., Upward needleless electrospinning of multiple nanofibers, Feb. 27, 2004, 4 pages, Polymer 45 (2004) 2977-2980, available online at www.sciencedirect.com.

Timothy H. Grafe et al., Nanofiber Webs from Eletrospinning, 5 pages, pp. 1-5, Presented at the Nonwovens in Filtration—Fifth International Conference, Stuttgart, Germany, Mar. 2003, 2003 Donaldson Company Inc., Minneapolis, MN, USA.

Pankaj Gupta et al., Electrospinning of linear homopolymers of poly(methyl methacrylate): exploring relationships between fiber formation, viscosity, molecular weight and concentration in a good solvent; article; Polymer 46 (2005) 4799-4810; 2005; 12 pages, pp. 4799-4810; Elsevier; available online at www.sciencedirect.com.

* cited by examiner

FINE FIBER ELECTRO-SPINNING EQUIPMENT, FILTER MEDIA SYSTEMS AND METHODS

FIELD OF THE INVENTION

The present invention generally relates to electrostatic spinning of fine fibers from a polymeric solution in an electrostatic field created by a voltage differential between a spinning electrode and a collecting electrode and more particularly relates to a new spinning electrode equipment arrangement and/or electro-spinning methods. Other aspects of the invention may also relate to filter media production systems and methods, that is application of fine fibers to filter media so as to create a high efficiency layer upon the filtration media for filtering contaminants out of a fluid stream.

BACKGROUND OF THE INVENTION

The production of fine fibers from polymeric solution through electrostatic spinning (a.k.a. "electro-spinning") via an electric field created by a voltage differential between a collecting electrode and a spinning electrode is known. For example, as shown in U.S. Pat. No. 6,743,273, polymeric solution is pumped to a spinning electrode in the form of a rotating emitter in which the pump solution is pumped from a reservoir and forced through holes in the emitter. Upon exiting, the electrostatic potential between a grid and the emitter imparts a charge which causes the liquid to be "spun" as thin fine fibers where they are collected on a substrate as an efficiency layer. During this process, the solvent is evaporated off the fine fibers which draws down the fiber diameter during their flight.

Another example of an electrostatic spinning device is shown in Patent Publication Nos. US2006/0290031 and WO2006/131081. The spinning electrode designs disclosed in these applications are in the form of a rotating drum-like body that may take several different forms. The drum is situated and bathed within a polymeric solution reservoir and is rotated about an axis perpendicular relative to the path of a collection media. By rotating the drum through the polymer solution, the spinning surface of the charged electrode is coated with the polymeric solution. Various drum like body variations are shown throughout these two patent publications providing multiple pointed tips to create discrete spinning locations where fine fibers are generated.

The present invention provides for improvements over the existing state of the art as it relates to electrostatic fine fiber production and spinning electrode design and/or in relation to the production of fine fiber filtration media.

BRIEF SUMMARY OF THE INVENTION

The present invention has several aspects that may be claimed and stand as patentable individually or in combination including but not limited to the following.

A first aspect of the present invention is directed toward an apparatus for production of fine fibers onto a suitable collection media. The apparatus includes two electrodes which are spaced apart in which the spinning electrode includes a strand that is entrained upon at least two guides. The apparatus has an entrance region and an exit region that are spaced apart along a first path such that the collection media is adapted to be driven along the first path from the entrance region to the exit region in spaced relation from the spinning electrode. A drive unit is adapted to drive the strand along the at least two guides for movement along a second path that is transverse to the first path (e.g. crosswise and may be perpendicular according to certain embodiments). A voltage source is arranged to generate a voltage differential between the first and second electrodes for generating an electrostatic field for the spinning of fine fibers.

The strand may take the form of a chain, band, strip or other strand structure. According to a preferred embodiment, the strand can take the form of an endless strand that is driven about an endless continuous path. The second path mentioned above is a part of this endless path. The endless path further includes a return path in spaced relation with the endless strand that is further away from the collecting electrode along the return path as compared with the second path where electrospinning of fine fibers occur. Additionally, according to certain embodiments, a dipping basin is provided which is adapted to contain a suitable polymer solution. The endless strand along the return path runs through the dipping basin for dipping into the polymer solution and thereby coats the endless strand with the polymer solution.

Another aspect of the present invention is directed toward a filter media production system. The system includes a roll of substrate material that supplies a sheet of substrate material along a first path through an entrance region to an exit region of fine fiber generation machine. The sheet has opposed side edges generally parallel to the first path. The fine fiber generation machine includes at least one strand and a drive unit driving the strand along a second path from a first guide to a second guide that is transverse relative to the first path. The strand is wetted with a polymer solution and subject to a voltage differential to provide an electrostatic field for generating fine fibers that are subsequently deposited upon the substrate material.

According to certain embodiments, such an aspect may also involve an endless strand which is run along an endless path and may also relate to dipping a portion of the endless strand at any one given time within a basin of polymer solution to replenish the coating of polymer solution upon the endless strand.

Another inventive aspect includes an apparatus for the production of fine fibers onto a collection media, wherein at least one spinning electrode has a linear segment maintained at a constant spacing relative to a planar collection electrode. According to this aspect, a collection electrode has a planar support surface for supporting the collection media, at least one spinning electrode has a linear segment adjacent the planar support surface and a drive unit drives the spinning electrode, while maintaining a constant spacing between the linear segment and the planar support surface when driven by the drive unit. A voltage source is arranged to generate a voltage differential between the first and second electrodes for generating the spinning of fine fibers.

According to certain embodiments, the apparatus can include an entrance region and an exit region spaced apart along a first path, wherein the collection media is adapted to be driven along the first path from the entrance region to the exit region in spaced relation from the spinning electrode. The spinning electrode is driven about an endless path with a dipping basin provided to contain a polymer solution. At any one moment, part of the spinning electrode is run through the dipping basin for dipping into the polymer solution and thereby coating the spinning electrode with the polymer solution, and part of the spinning electrode being exposed for fine fiber generation.

Yet another inventive aspect relates to a method of generating fine fibers while maintaining a constant spacing. A method according to this inventive aspect includes electrospinning fine fibers from an electrode at a plurality of spinning locations arranged in a linear array from a polymer solution coating on the electrode; facilitating relative movement between the collection media and the spinning locations with the spinning locations in spaced relation to the collection media; depositing the fine fibers on the collection media; maintaining a constant spacing between the spinning locations and the collection media; and periodically regenerating each of the spinning locations with polymer solution coating.

Yet another inventive aspect relates to a method of generating fine fibers that includes arranging a first electrode and a second electrode in spaced relation wherein the second electrode includes at least one strand; generating a voltage differential between the first electrode and the second electrode; wetting the strand with a polymer solution; running collection media in spaced relation to the second electrode along a first path; spinning fine fibers of polymer material onto the collection media along a plurality of spinning locations along the at least one strand due to the voltage differential; and running the strand along a second path transverse to the first path.

According to certain embodiments, the methods above may involve entraining an endless strand upon at least two guides, which may take the form of guide wheels; running the endless strand along an endless path around at least two guides; generating fine fibers from a first portion of the endless strand that is exposed and facing the collection media; and dipping a second portion of the endless strand into the polymer solution and thereby periodically regenerate spinning locations. Even further, fine fibers can be generated typically from a plurality of discrete segments that are separated by gaps across the electrode strand. The spinning locations can migrate across the media transversely relative to the first path along which the media runs as the endless strand is run along the second transverse path.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
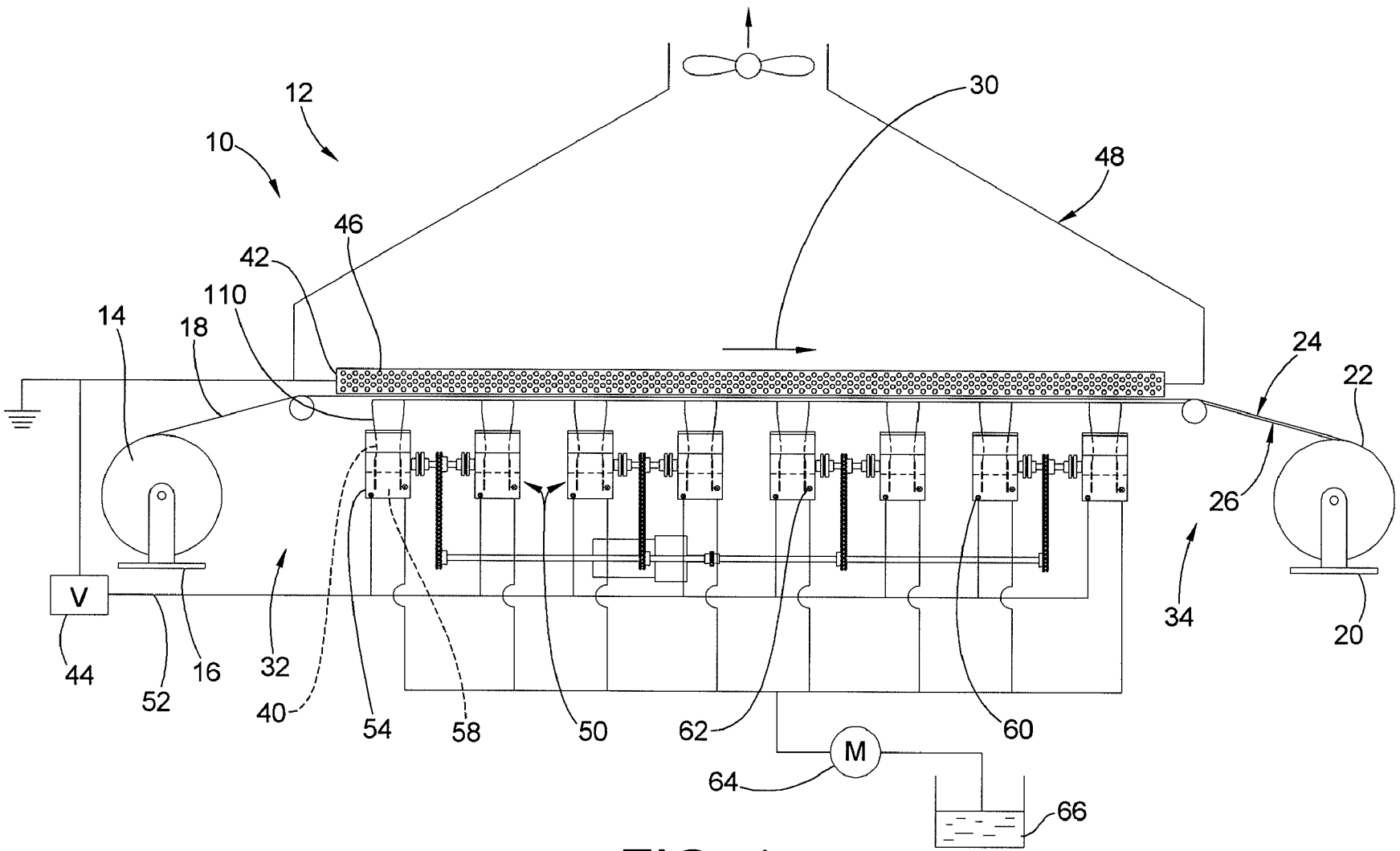
FIG. 1 is a partly schematic side elevational view of a fine fiber generation machine which may be used for production of filtration media in accordance with an embodiment of the present invention.
Figure 2:
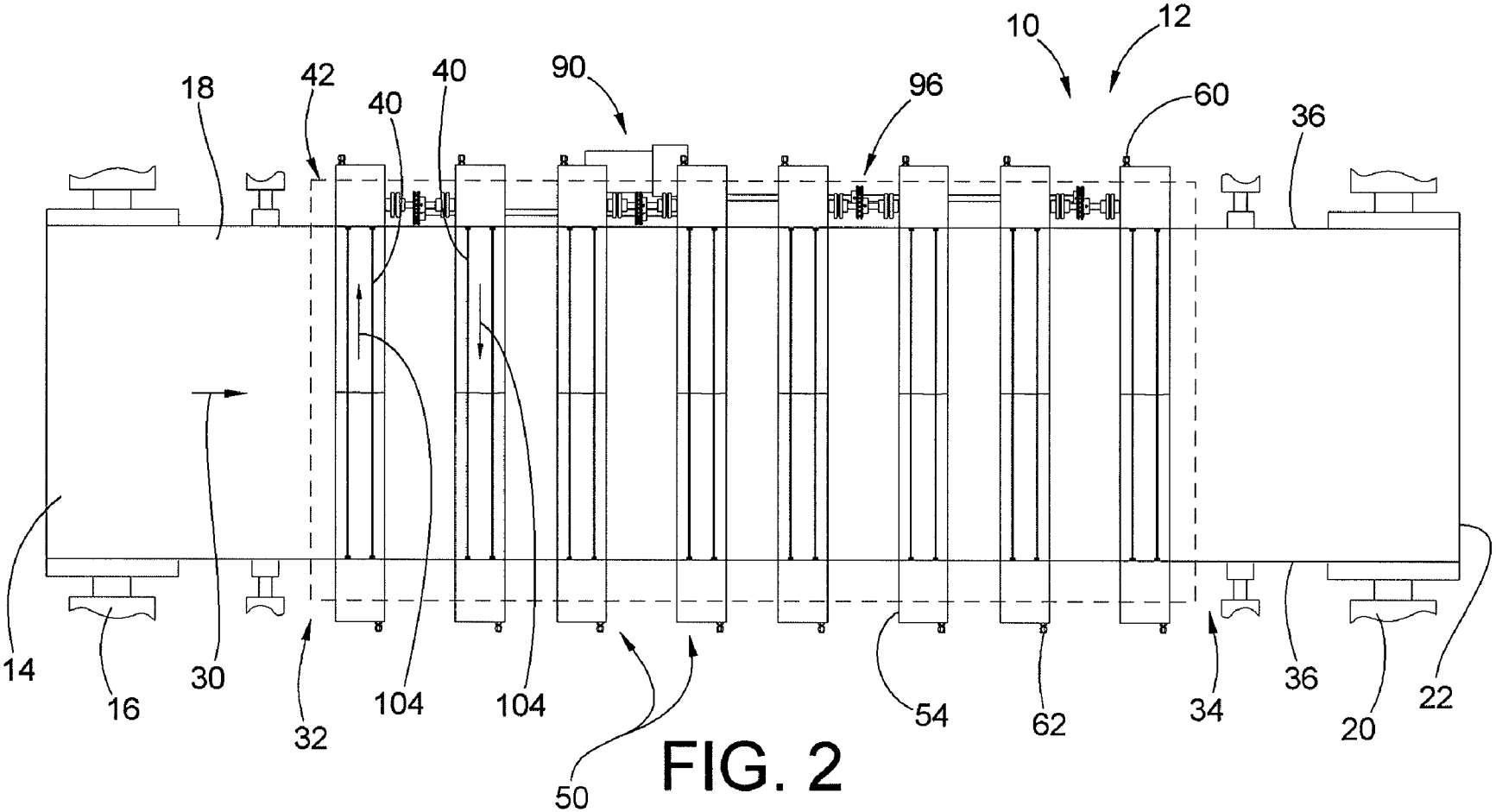
FIG. 2 is a partly schematic plan view of the machine shown in FIG. 1.

For purposes of illustration, an embodiment according to the invention is illustrated in partial schematic form as a fine fiber production machine 10 as part of a filter media production system 12 in FIGS. 1 and 2. The production system includes a replaceable master roll 14 of fine fiber collection media substrate shown in the form of a filter media substrate roll 14 that is arranged upon a unwind machine 16. The continuous substrate sheet 18 is fed from the filter media substrate roll 14 through the fine fiber production machine for collecting fine fibers and is rewound by a rewind machine 20 on a filter media roll 22 having a filter media substrate layer 24 and a high efficiency fine fiber layer 26. After the master substrate roll 14 is depleted, a new filter media substrate roll can be replaced thereon as needed.

As shown, the sheet 18 of media runs along a first direction 30 through the fine fiber production machine 10 generally from an entrance region 32 to an exit region 34. The sides 36 of the filter media sheet generally run parallel with this first direction 30 naturally.

The fine fiber production machine includes an electrostatic field that is generated between first and second electrodes to include one or more spinning electrodes 40 whereat fine fibers are generated on the one hand and a collection electrode 42 to which the fine fibers are drawn under the force provided by the electrostatic field. As shown, the media sheet 18 is typically run between the spinning electrode 40 and the collection electrode 42 such that the fine fibers are usually not deposited upon the collection electrode 42 but instead deposited on the filter media sheet 18. The collection electrode 42 is preferably a conductive perforated plate of substantial surface area for maximizing locations to where threads are collected. Many small holes 46 are formed in the perforated plate to facilitate vacuum suction of evaporated solvent through a blower driven ventilation hood system 48 that evacuates evaporated solvent to an external location such as outside a facility. As schematically shown, the collection electrode 42 spans at least the width of media and the length of spinning electrodes 40, collectively, as does the ventilation hood system 48. The filter media substrate layer runs in contact and is supported against the collection electrode 42 under suction pressure against gravity. Preferably, this support arrangement is flat and planar as illustrated.

To generate the electrostatic field, a high voltage supply is provided and that is connected to at least one of the electrodes 40, 42 for generating a high voltage differential between the electrodes 40, 42 on the order of between 10,000 and 150,000 volts or more (and more preferably for the production of fine fibers for filter media between 75,000 and 120,000 volts), although other voltage ranges may be possible. Typically, the collection electrode 42 will simply be grounded however, the voltage generation source may provide a potential to the collection electrode other than ground such that the spinning electrode may not necessarily be at such a high voltage potential relative to ground. In either event, a voltage source is arranged to generate a voltage differential between the first and second electrodes sufficient for generating the spinning of fine fibers from polymeric solution through an electrostatic field.

Figure 3:
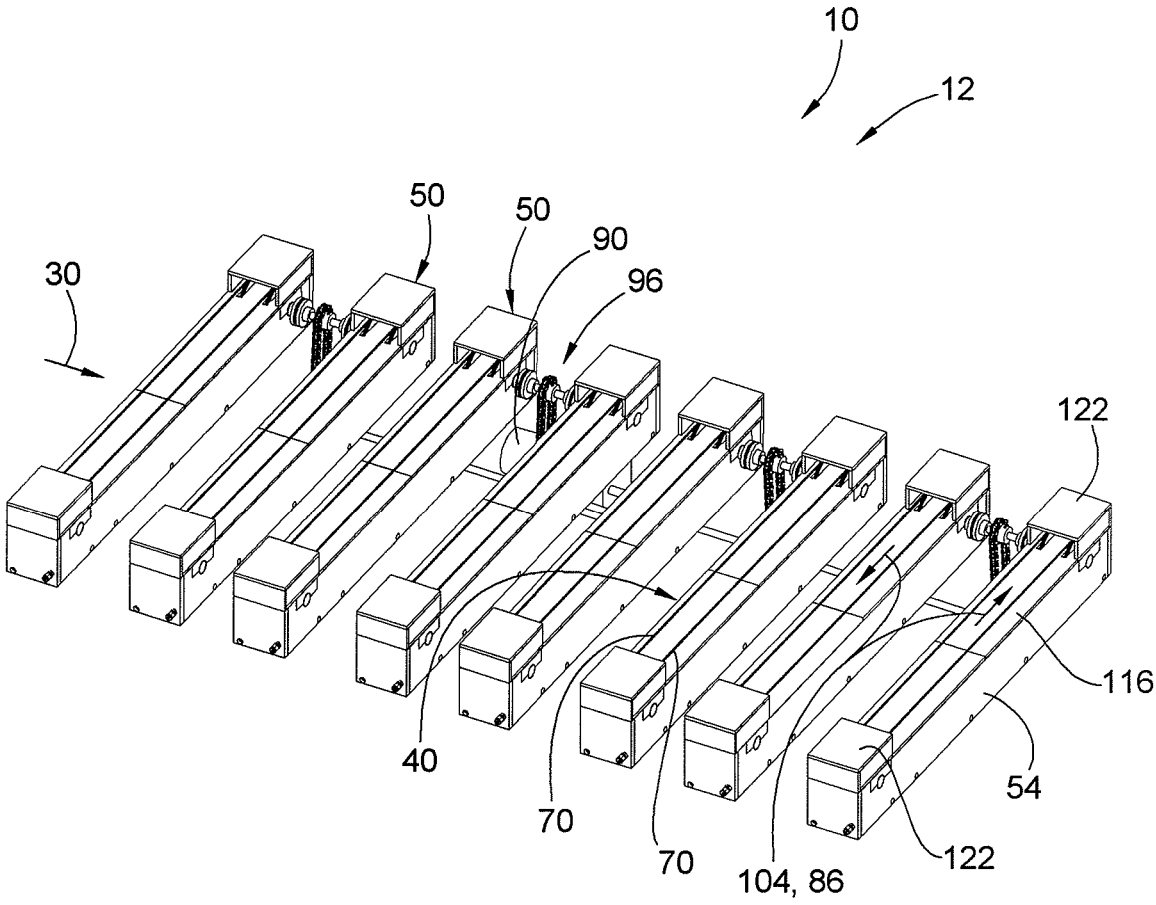
FIG. 3 shows an isometric view of a plurality of polymeric solution basins and electro-spinning electrodes and appropriate drive mechanism for driving the same in accordance with an embodiment of the present invention and which may be incorporated and used in the schematic illustration shown in FIG. 1.
Figure 4:
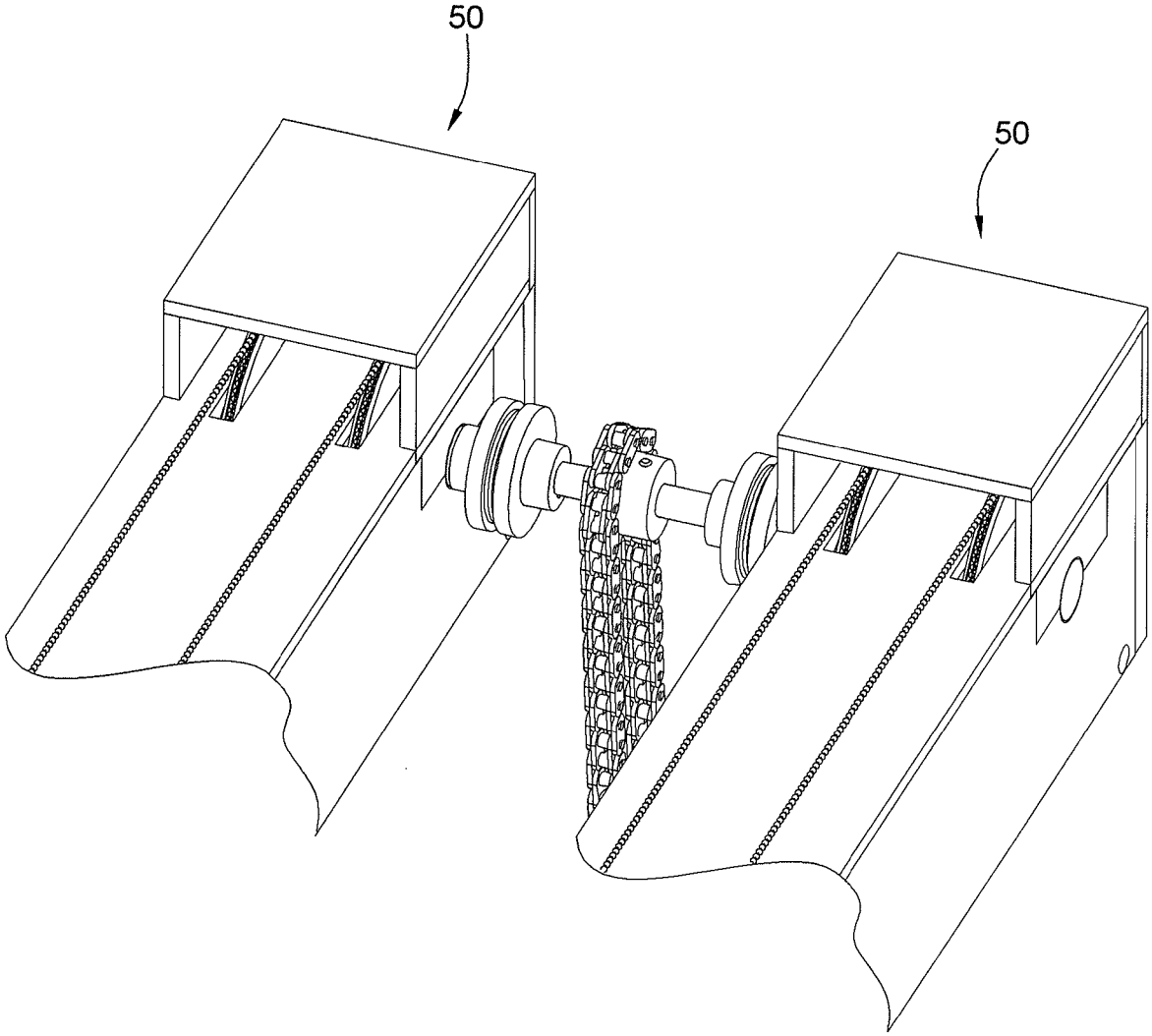
FIG. 4 is a enlarged view of a portion of the apparatus shown in FIG. 3.
Figure 5:
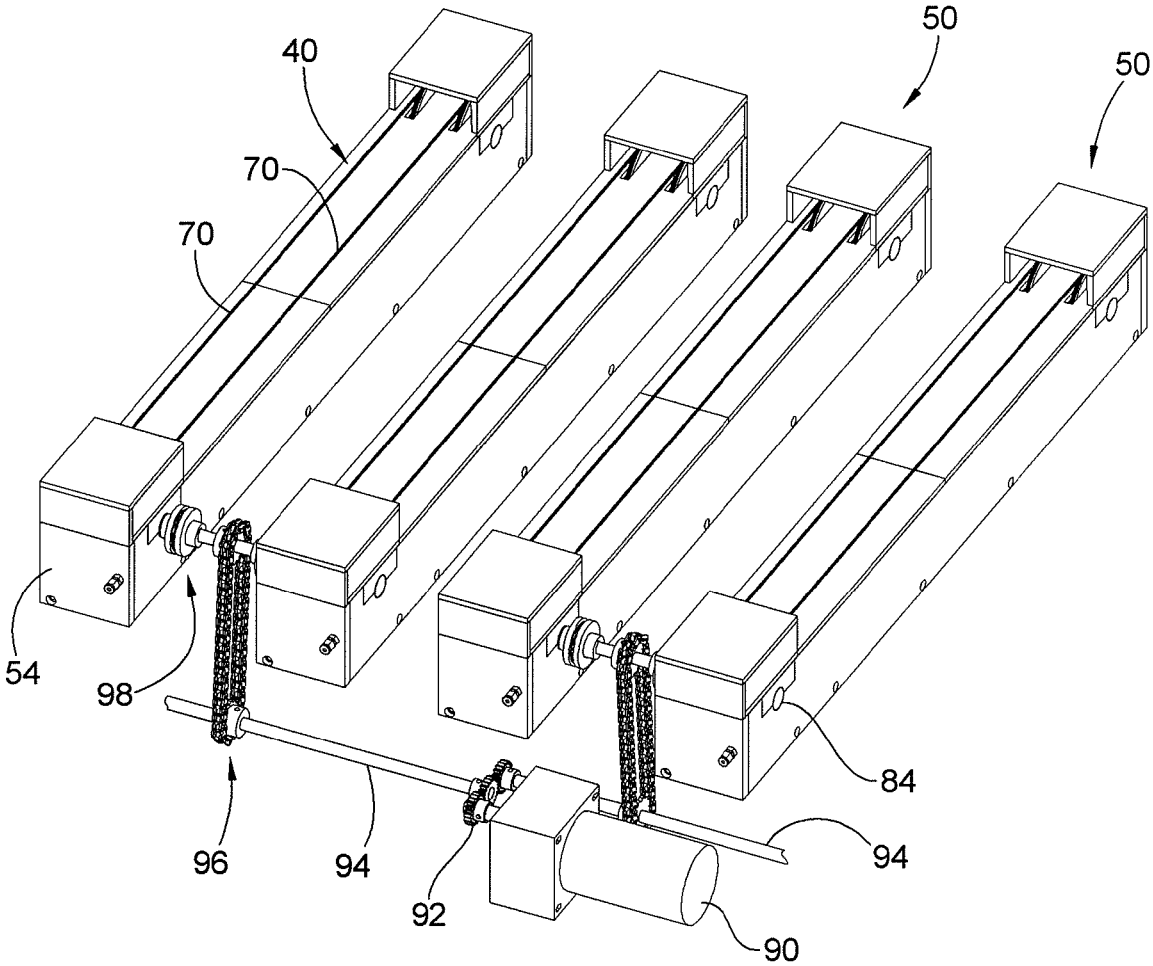
FIG. 5 is an enlarged and different isometric view of a portion of the apparatus shown in FIG. 3 to better illustrate an example of a drive unit.

In one embodiment, an apparatus includes a single spinning electrode 40. For example, the single electrode of FIG. 7 may be used to form its own machine. As shown in the other figures, multiple spinning electrodes 40 can be provided between the entrance region 32 and the exit region. One or more spinning electrodes may be assembled as a unit in an individual fine fiber production cell 50. For example, multiple fine fiber production cells 50 can be arranged between entrances and exit regions as shown in FIGS. 1-3. Each of the fine fiber production cells 50 is coupled to the high voltage supply 44 via an electrical wire 52 and each of the cells are subject to the same electrical voltage potential and differential relative to the collection electrode 42.

Figure 7:
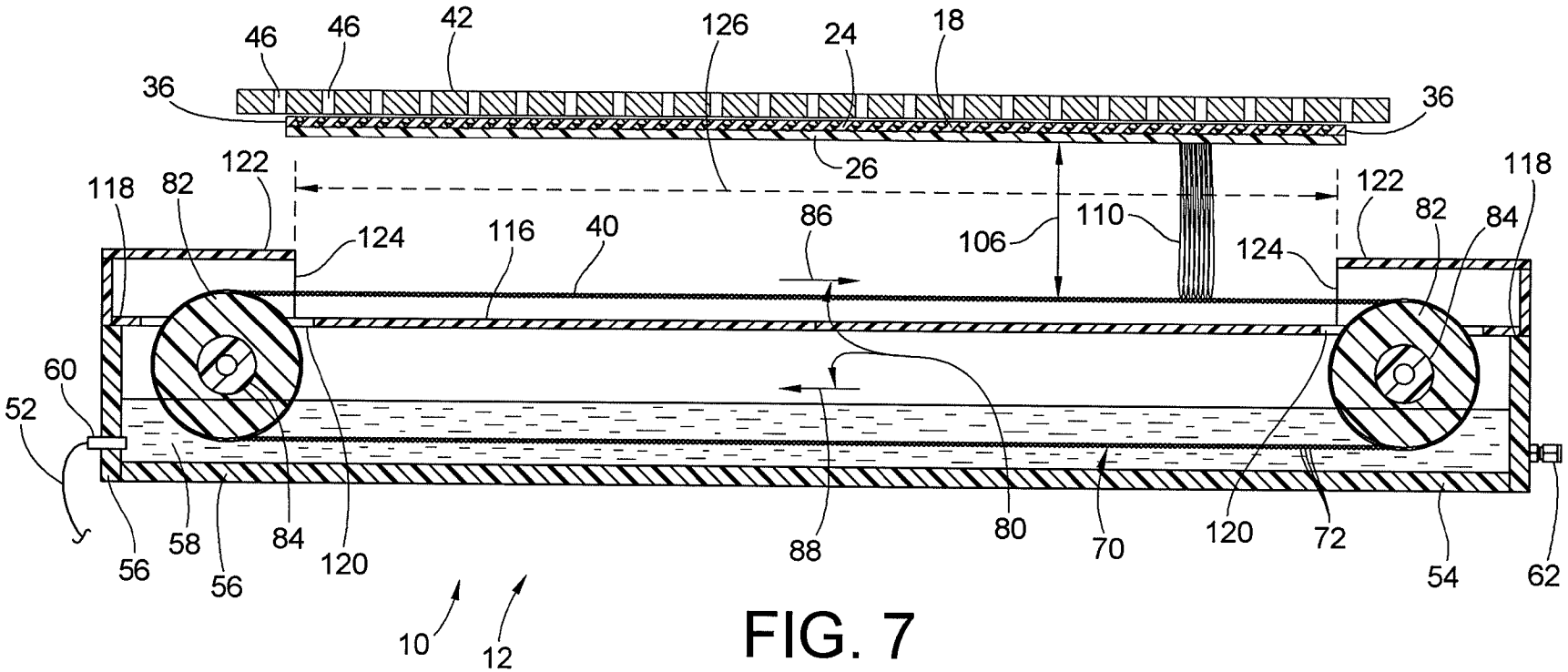
FIG. 7 is a cross sectional view of one of the electro-spinning cells or units shown in FIG. 3.

Turning in greater detail to an individual production cell 50, with reference to FIG. 7, each cell 50 includes a dipping basin 54 which may take the form of a plastic walled box like vessel structure. Each of the walls 56 of the dipping basin 54 are constructed from insulating material such as plastic (but a plastic or other insulating material that is not considered soluble for the planned solvents to be employed) so as to prevent unintentional discharge of the voltage communicated into the basin 54 from the high voltage supply 46. The dipping basin 54 contains a polymeric solution 58, comprising a suitable solvent and a suitable polymer for electro-spinning of fine fibers.

Mounted into one of the plastic walls 56 is the metal electrical terminal 60 that extends through one of the walls 56 and that is connected by an electrical wire 52 to the high voltage supply 44. The terminal 60 is in communication with the polymeric solution 58 and thereby charges the solution for communication of the voltage potential therethrough along to the spinning electrode 40.

Additionally, to provide for periodic replenishment of the polymeric solution, a fluid coupling such as quick connect coupling 62 that conventionally includes a one-way check valve is mounted into and through one of the walls 56 to allow for periodic replenishment of the polymeric solution through the addition of more such solution. This may be hooked up to a fluid replenishment system that periodically replenishes the basin with more polymeric solution to include a fluid metering unit 64 and a reservoir 66. Control valves or individual metering units (one dedicated to each cell) may be provided to individually control the solution in each cell.

As shown, the spinning electrode 40 may take the form of a strand and as shown in the embodiment, an endless strand in the form of an endless chain 70. The endless chain 70 is preferably made of metal or other conductive material such that it is readily conductive and is in electrical circuit with the high voltage supply 44 by virtue of electrical communication provided by and through the polymeric solution 58. The endless chain 70 preferably includes a plurality of individual discrete segments 72 as shown best in FIG. 8. Each of the discrete segment is connected and spaced from another adjacent segment by a gap 74 and spacer segment 76. In this embodiment, the segments 72 are beads that form a bead chain in which the individual beads that take the form of generally spherical balls 78. For example, a stainless steel metal beaded chain can provide for the spinning electrode.

The endless chain 70 is mounted along an endless path 80 around two guides which may take the form of movable guide wheels 82 that are spaced at opposite ends of the dipping basin 54. The guide wheels 82 may be sheave like structures as shown and can be metal, plastic or other suitable material. The guide wheels 82 are mounted for rotation on insulating axels 84 such as plastic material axles so as to insulate the voltage potential within the dipping basin 54. The axles 84 are rotatable relative to the walls 56 of the dipping basin 54. The endless chain 70 is entrained about the guide wheels 82 to include a linear spinning path 86 that is exposed outside of the polymeric solution 58. The spinning path 86 faces and is closest to the collection electrode 42. The endless chain 70 also has a linear return path 88 which runs through the dipping basin 54 and the polymeric solution 58 for the purpose of periodically regenerating the segments of the endless chain, that is by dipping the chain and running it through the polymeric solution. At any one time a portion of the chain is being regenerated with solution and a portion is exposed for electro-spinning.

Figure 6:
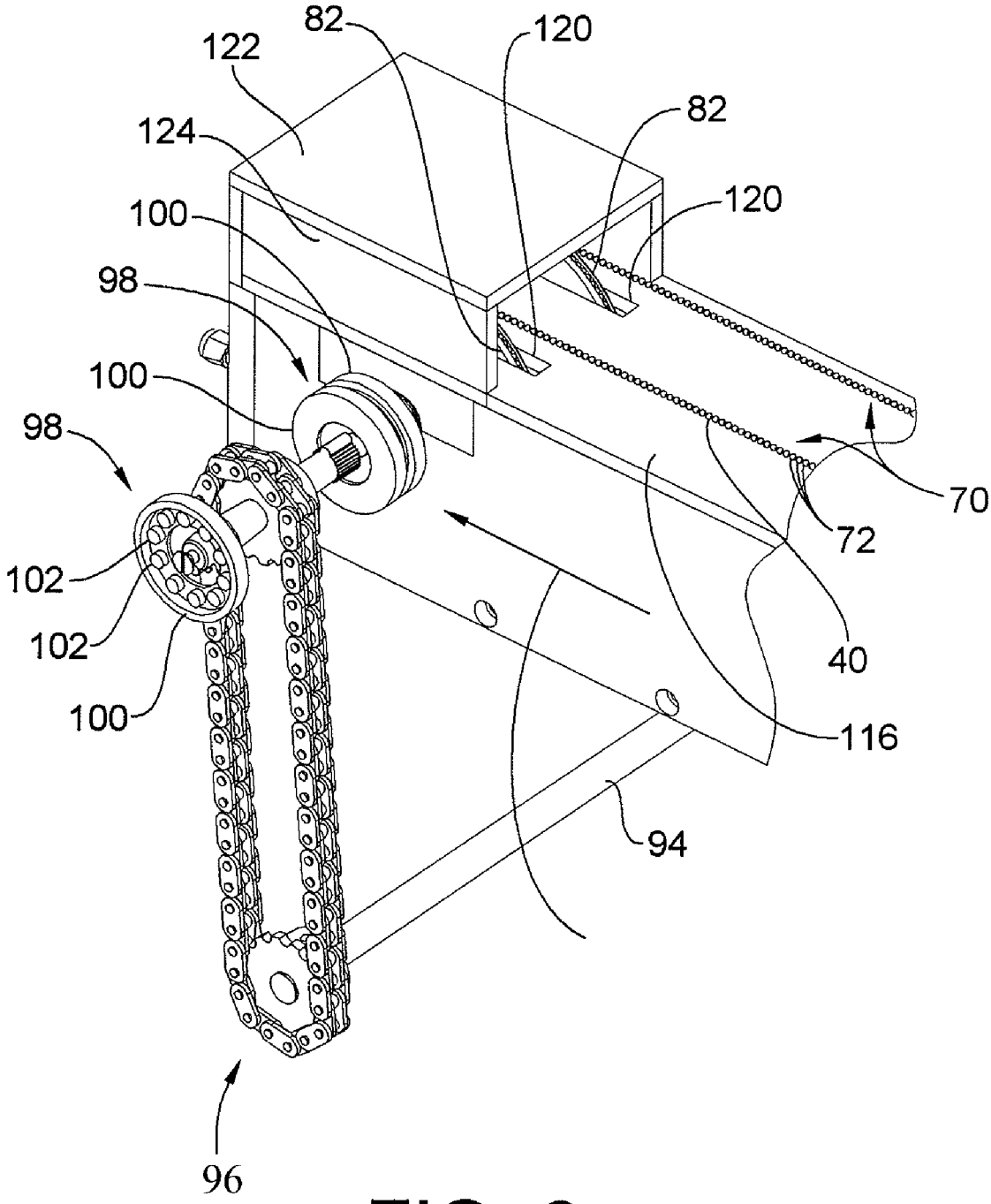
FIG. 6 is an enlarged side view of one of the individual units of the apparatus shown in FIG. 3.

To drive the endless chain 70 along the endless path 80 about the guide wheels 82, a suitable drive unit is provided, which includes a rotary motor 90 having a rotary output upon an output shaft 92. The output is then transferred through gearing to a transmission shaft 94 that transmits through the chain and sprocket mechanism 96 to electrical isolation drives 98. These drives 98 include separated but closely arranged housings 100 (See FIG. 6) containing permanent magnets 102 that are configured in an offset arrangement (magnets interposed between each other) as shown such that when operated rotation of one of the housings 100 causes the other housing 100 to rotate due to the interspersed relation of the permanent magnets 102 among the two housings and the repulsion or attraction generated thereby. One of the drive housings 100 is mounted to at least one of the guide wheels 82 for each dipping basin cell so that the guide wheel also doubles as a drive wheel to drive the endless chain 70 about the endless path 80. Of course, other appropriate drive units may be provided to drive the endless chain 70 about the endless path 80.

As can be seen from FIGS. 1, 2 and 7, the linear spinning path 86 portion of the endless chain 70 extends transversely relative to the first direction for movement along a second direction 104 that is preferably transverse (that is either perpendicular or otherwise lying crosswise such as diagonally or obliquely) relative to the first direction 30. As a result, as the sheet of media is moving along in the first direction 30 from the entrance region 32 to the exit region 34 the individual segments 72 of the endless chain 70 are moving along in the second direction 104 across the substrate sheet between opposed sides 36.

Additionally, as shown best in FIG. 7, there can be a constant spacing distance 106 of the segments 72 from the collection electrode 42 and/or the media sheet 18 as the individual segments 72 move across the entire linear spinning path 86 from one end to the other. Such a constant target distance may include minor variations due to sag in the endless chain which do not materially affect the fine fiber production. As a result, the spinning target spacing distance 106 can be tightly controlled and is not subject to wide variations as may be the case in rotating drum applications. To the extent there is sag in the endless chain along the linear spinning path 86 that is undesirable, intermediate guide supports (not shown) can be provided along the path that which may also periodically regenerate polymeric coating upon the endless chain. Such additional intermediate support apparatus may be provided in the event that electro-spinning across much longer spans are desired. Intermediate regeneration could be accomplished by pumping polymeric solution from a needle onto the chain and/or through a transfer wheel that picks up solution and transfers it onto the endless chain. In any event, to the extent there is any minor sag in the endless chain along the spinning path, it still is literally considered to include a constant spacing distance 106 within the meaning and context of the present invention and claims appended hereto, and the movement along the spinning path 86 will still literally be considered to be linear within the context of the present invention and claims appended hereto.

As evident from the foregoing, the linear spinning path 86 and movement direction of the endless chain 70 is transverse relative to the movement direction 30 of the collection media sheet 18. Preferably and as shown this transverse arrangement is preferably perpendicular although it is appreciated that other transverse arrangements including angles other than 90° may be used. Thus, in the context herein, transverse includes but does not mean perpendicular but is broader in the sense and is meant to also include a strand for electro-spinning generation that moves generally crosswise in a direction generally between the opposed sides 36 of the collection media sheet 18.

According to an operational mode embodiment, during operation the filter media collection sheet 18 runs along the first direction continuously as well as the endless chain 70 moving about the endless path 80 continuously. However, it will be appreciated that intermittent operation of either can be accomplished if desired for various purposes.

Figure 8:
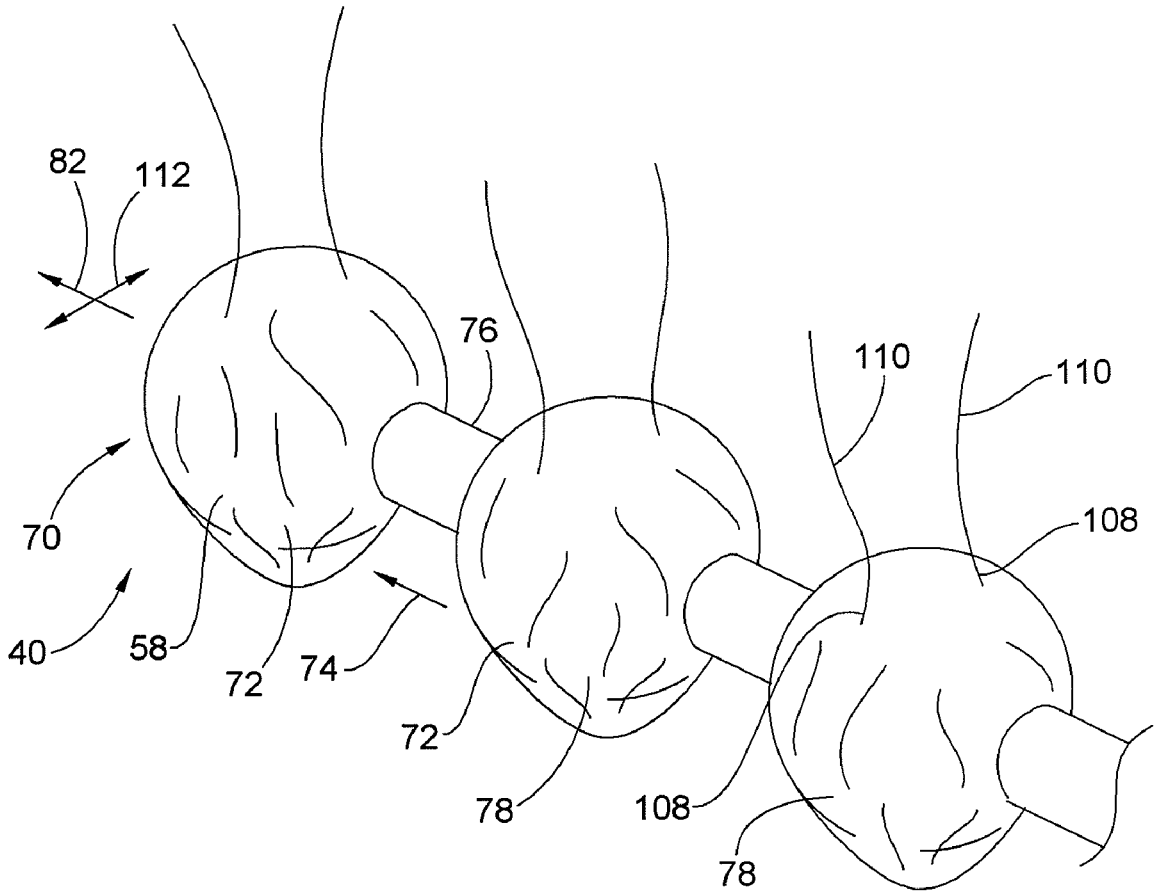
FIG. 8 is a close up demonstrative illustration of a portion of the endless chain electrode used in the aforementioned figures for use in explaining how at least two spinning locations are typically formed from a polymeric solution coating on each of the individual chain segments during operation.

During operation and as shown in FIGS. 7 and 8, the endless chain 70 along the linear spinning path 86 includes multiple spinning locations 108 which are linearly aligned in an array of at least one row and as shown two rows. The spinning locations are spaced by the gaps 74 which in the case of the present embodiment are equally spaced gaps 74 such that the spinning locations 108 are equally spaced along the linear spinning path 86. The reason is that configuration of the spherical balls 78 generates typically two spinning locations 108 for the formation of fine fibers 110. As shown, the spinning locations 108 are on opposite sides of the spherical ball 78 and spaced apart along a lateral axis 112 that is perpendicular relative to the linear spinning path 86 by virtue of electrical repulsion (e.g. the charged spinning threads tend to repel each other). Thus the curved nature of the individual segments 72 is beneficial in producing the desired spacing between spinning locations and providing multiple spinning locations per each individual segment thereby producing more fine fiber and controlling the production of fine fiber for uniformity purposes. However, it would be appreciated other configurations could be made such as providing a sharp edge for the production of a spinning location or a non-segmented strand.

In the case of water soluble polymers in which water is used as the solvent, the apparatus may be used in an uncovered state. However, the disclosed embodiment has a significant optional and preferred feature that provides for significant advantages over traditional dipping systems by providing a central cover 116 that is arranged to substantially cover the otherwise open end 118 of the dipping basin. With this arrangement, it can be seen that the endless chain electrode is driven around the cover to include a first portion which is contained within the dipping basin and substantially encapsulated therein by the cover and a second portion that is exposed and capable of generating fine fibers. The cover 116 can be interposed between different parts of the electrode as shown and can substantially enclose dipping of the electrode. The cover 116 extends substantially between the spaced apart guide wheels 82 and in the present embodiment may include guide wheel slots 120 receiving the guide wheels therethrough and providing an opening through which the endless chain 70 can pass. In the case of the present embodiment, including two endless chains 70 per cell 50 with only two guide wheels 82 provided for each endless chain 70, a total of four slots 120 may be provided. Additional slots may be provided for additional guide wheels where other support apparatus as may be desired or needed. The cover 116 is particularly advantageous when the polymer solution involves a volatile solvent and/or a solvent other then water. For example, certain solvent materials can evaporate more quickly than water and therefore make it more difficult to maintain a desirable polymer to solution ratio. The cover 116 minimizes the amount of solvent that is exposed externally at any one moment and thereby minimizes solvent loss. This is also perhaps more advantageous from a materials savings and environmental standpoint.

For example, a comparison of a covered endless beaded chain embodiment according to the disclosure of FIGS. 1-8 with a commercially available machine that has an uncovered configuration, namely, an El-Marco NANOSPIDER model NS-8A 1450 machine, available from El-Marco, s.r.o., Liberec, Czech-Republic has shown considerable solvent savings over a 16 hour testing period. In particular, for spinning polymer fine fibers from a 12% polymer solution (polymer to solution ratio), such as nylon 6 using a ⅓ formic acid and ⅔ acetic acid solvent, replenishment of the local polymer solution in the uncovered dipping basin of the El-Marco machine has required replenishment of the dipping basin with a much diluted polymer solution (and hence more solvent) to maintain the 12% solution in the dipping basin due to evaporated solvent loss. Specifically, the El-Marco machine required a solvent rich replenishment solution of a 2% solution. Whereas, an embodiment has been able to achieve maintenance of a 12% polymer solution with a more polymer rich solution of a 7% replenishment solution due to less solvent evaporation. In making this comparison, it is acknowledged that not all of the parameters of the machines are equal (e.g. among other things: the electrodes are differently configured and driven differently, the collection media flow rate may be different, the dipping basin tub size can be smaller in an embodiment of the invention considering it can be thinner in the movement direction of the collection media as it need not accommodate rotation of a drum-like electrode).

Nevertheless, considering evaporation relates in large part to available surface area (and such things as surface agitation and air flow—e.g. around the entry and exit regions of the dipping portion of the electrode), solvent savings is primarily due to the basin and electrode covering technique disclosed herein. For example, the embodiments of FIGS. 1-8 substantially cover the surface of polymer solution and also the electrode dipping entry and exit locations (areas of agitation). As such, other parameters are not seen to impact evaporation loss in a significant manner. In comparing machines, it has been calculated that the solvent evaporation savings may be up to 60% or more. Much of this advantage is considered due to the covering of the electrode during dipping and substantially enclosing the polymer solution. As such, preferably enough covering is provided to reduce solvent loss by at least 25% and more preferably by at least 50%.

In practicing one embodiment, the cover 116 can be fastened securely to the walls of the dipping basin 54 by virtue of screws or otherwise. The configuration and attachment of the cover may depend upon electrode configuration. Other arrangements or other types of electrode spinning systems are possible. Preferably, the cover reduces evaporation from solvent of the polymer solution by at least 25% as compared to an uncovered electrode spinning apparatus and even more preferably by at least 50%. For example, savings of approximately two-thirds of solvent is demonstrated by the above example.

Additionally, the illustrated embodiment includes end covers 122 at opposed ends of the cell 50 that are mounted to wall extensions 124 that extend above the cover 116 such that the end covers 122 are positioned over the opposed ends of the endless chain 70 and are disposed over the guide wheels 82. The end covers 122 also serve to reduce solvent evaporation but also serve as shrouds to limit the span of fine fiber production. As shown, the end cover span 126 between the inner edges of opposed end covers is about the same and preferably just slightly larger then the width of the corresponding media sheet 18 defined between opposed sides 36. The end cover 122 may be adjustable and/or interchangeable with other longer end covers such that the span 126 may be adjustable to accommodate different widths of collection media sheets 18 that may be run through the fine fiber production machine 10.

Figure 9:
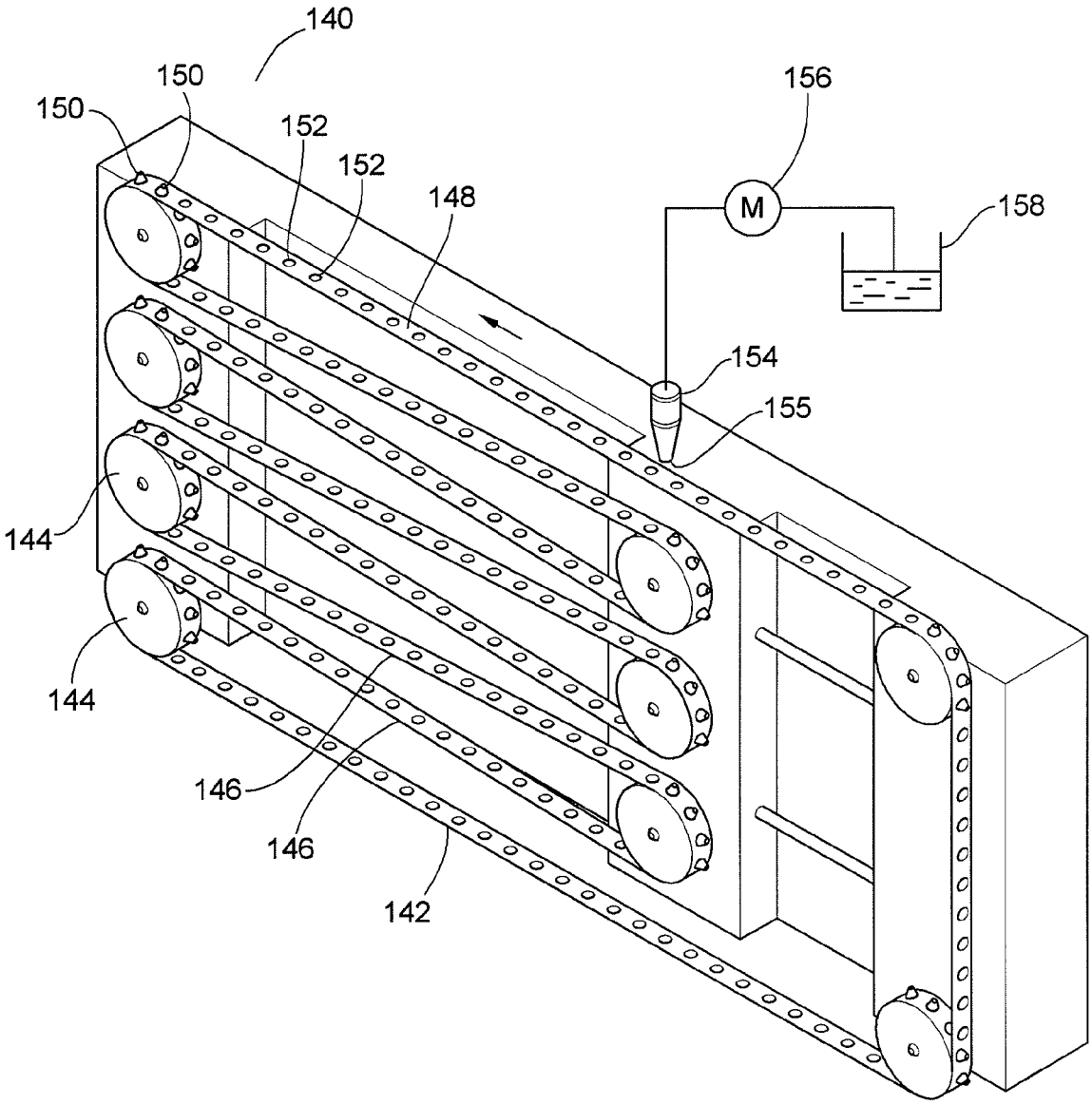
FIG. 9 is perspective illustration of a serpentine belt electro-spinning apparatus according to an alternative embodiment of the present invention.

Turning to FIG. 9, an alternative embodiment of the present invention is illustrated as a fine fiber production machine 140 that is similar in many respects to the first embodiment. For example, this embodiment similarly employs a strand that is wetted with polymeric solution and that can maintain a constant spacing of spinning locations relative to the collection media. Further, this embodiment also includes an endless strand that is driven about an endless path to provide a spinning electrode. As such, details will be directed toward some of the more salient differences.

In this embodiment, the fine fiber production machine includes an endless serpentine belt 142 that is driven in an endless path around multiple guide wheels 144. The serpentine belt 142 is preferably made of a conductive material and may take the form of a continuous endless metal band as shown to provide for a spinning electrode. The serpentine belt 142 includes several linear segments 146 between adjacent guide wheels 144 that each provide for multiple spinning locations. Generally, the edge 148 that would be disposed closest to the collection electrode provides for the spinning locations. This edge 148 can be serrated to provide multiple discrete and equally spaced sharp edges (not shown) and/or can be configured with pockets and the like to provide for local polymeric solution fluid reservoirs along the edge 148. Preferably, the guide wheels include teeth 150 or other positioning structure which engage holes 152 and other similar positioning structure on the belt 142 such that the edge can be maintained at a constant spacing and thereby maintain a constant spacing distance if such a constant spacing is desired.

The serpentine belt 142 is subject to a voltage source to generate the electrostatic field thereby serving as a spinning electrode. To provide for polymeric solution along the belt 142, this embodiment includes a wetting supply system that includes one or more needles 154 having control orifices 155 spaced adjacent to the edge 148 of the serpentine belt 142. Additionally, the needles are connected along fluid lines to a pressurized polymeric solution source afforded by a pump 156 that delivers polymeric solution from a reservoir 158. Thus, the strand generation need not necessarily be dipped but can be alternatively wetted in other means in accordance with this embodiment. Additionally, this embodiment also affords the ability for dipping the electrode in a dipping basin. For example, portions of the serpentine belt can be arranged to run vertically as opposed to horizontally due to the flexible nature of a serpentine belt. Alternatively, the right hand portion may be dipped in a dipping vessel containing polymeric solution with the collection media arranged to run vertical as opposed to horizontally.

Figure 10:
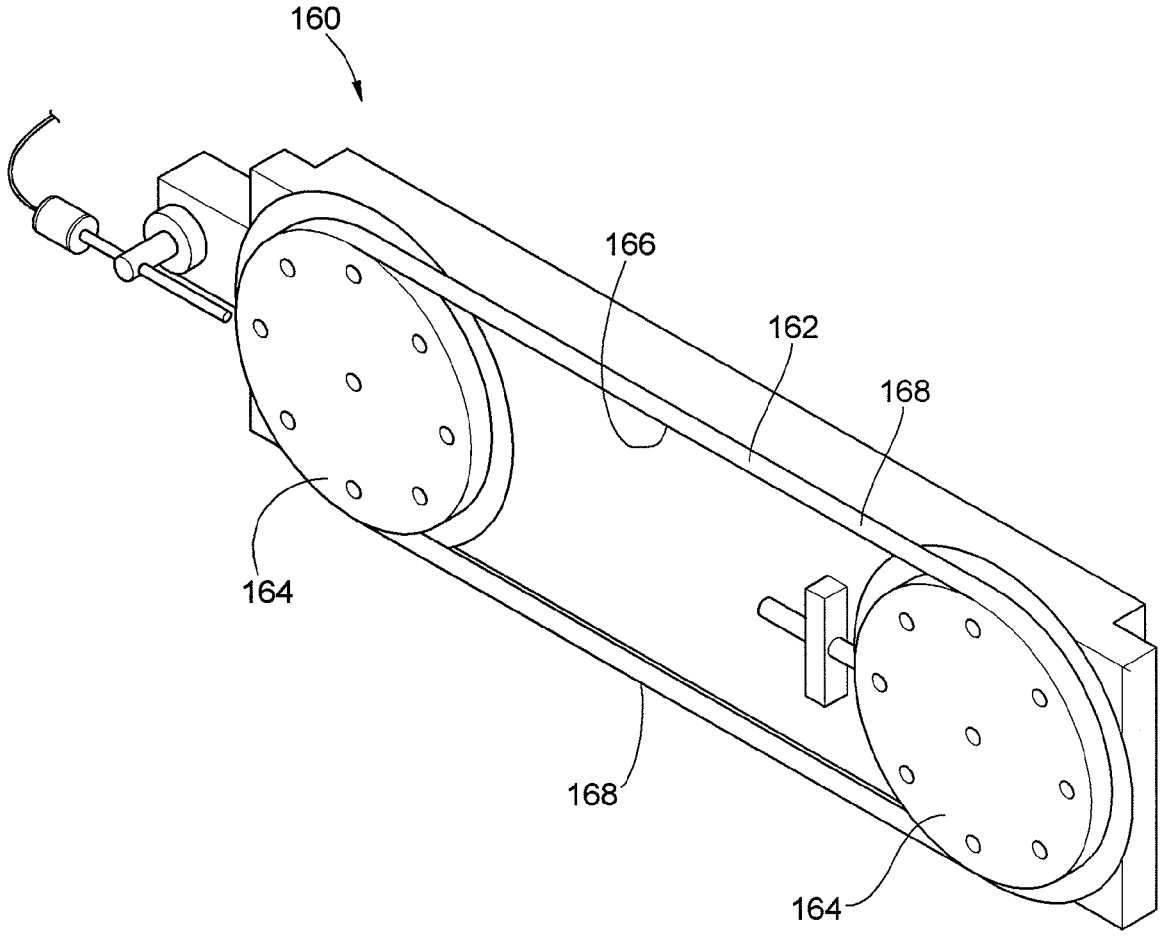
FIG. 10 is yet another alternative embodiment of the present invention involving two guide wheel pulleys driving an endless belt with a single needle dispensing location for wetting the belt with polymer solution during operation.

Yet a third embodiment of the present invention is shown in FIG. 10 as a fine fiber production machine 160 much like the prior embodiment of FIG. 9. As such, discussion will be limited. This embodiment similarly can employ a polymeric supply system comprising a needle control orifice, pump and polymeric solution reservoir. This embodiment also employs an endless strand which in this embodiment takes the form of a more simplistic metal band 162 driven around two pulleys 164. Fiber generation can be obtained from the edge 166 that is intended be disposed closest to the collection media (not shown). This embodiment is also much like the first embodiment except that both linear segments 168 of the band 162 are arranged for fiber production and may not be dipped in polymer solution. It should be noted that it is not necessarily that each of the segments 168 be maintained in a constant distance. For example, it may be beneficial to generate different fibers of different characteristics to have different fiber generation spinning electrode strands arranged at different distances relative to the collection media. In this embodiment, pulleys 164 may take the form of sheaves or other positioning structure to maintain positioning of the edge 166 relative to the collection media.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for the production of fine fibers onto a collection media, comprising:

a first electrode;

a second electrode spaced from the first electrode, the second electrode including a strand entrained upon at least two guides, wherein the strand is wetted with a polymer solution;

an entrance region and an exit region spaced apart along a first path, wherein the collection media is adapted to be driven along the first path from the entrance region to the exit region in spaced relation from the second electrode;

a drive unit adapted to drive the strand along the at least two guides for movement along a second path that is transverse to the first path;

a voltage source arranged to generate a voltage differential between the first and second electrodes for spinning of fine fibers;

an operating mode wherein the differential voltage draws the fine fibers from the polymer solution on the wetted strand, wherein a solvent in the polymer solution evaporates during a travel between the electrodes to draw down a fiber diameter to generate the fine fibers;

wherein the strand has a plurality of spinning segments separated by gaps in alternating fashion, the strand at the plurality of spinning segments being closer to the first electrode than at the gaps, wherein each spinning segment is adapted to provide at least one discrete spinning location wherein polymer fine fibers are electrospun during operation, wherein all of said spinning locations of the strand define a span of said spinning locations to facilitate spinning of fine fibers, the spinning locations being regularly spaced in number across the span so that fine fibers are adapted to be uniformly deposited over the span and onto the collection media; and wherein the strand is a beaded chain.

2. The apparatus of claim 1, wherein the strand is an endless strand driven about an endless path, wherein the second path is a part of the endless path, the endless path further including a return path spaced from the second path, the endless strand being farther away from the first electrode along the return path than the second path.

3. The apparatus of claim 2, further including a dipping basin adapted to contain a polymer solution, the endless strand along the return path running through the dipping basin for dipping into the polymer solution and thereby coating the endless strand with the polymer solution.

4. An apparatus for the production of fine fibers onto a collection media, comprising:

a first electrode;

a second electrode spaced from the first electrode, the second electrode including a strand entrained upon at least two guides;

an entrance region and an exit region spaced apart along a first path, wherein the collection media is adapted to be driven along the first path from the entrance region to the exit region in spaced relation from the second electrode;

a drive unit adapted to drive the strand along the at least two guides for movement along a second path that is transverse to the first path;

a voltage source arranged to generate a voltage differential between the first and second electrodes for generating the spinning of fine fibers;

wherein the strand is an endless strand driven about an endless path, wherein the second path is a part of the endless path, the endless path further including a return path spaced from the second path, the endless strand being farther away from the first electrode along the return path than the second path;

further including a dipping basin adapted to contain a polymer solution, the endless strand along the return path running through the dipping basin for dipping into the polymer solution and thereby coating the endless strand with the polymer solution;

wherein the endless strand is an endless chain of a plurality of discrete segments separated by gaps, wherein each segment typically provides at least one discrete spinning location wherein polymer fine fibers are electrospun during operation; and wherein each of the segments is a generally spherical ball.

5. The apparatus of claim 4, wherein the guides comprise a pair of spaced apart wheels rotatable about an axes that are generally parallel to the first path.

6. An apparatus for the production of fine fibers onto a collection media, comprising:

a collection electrode having a planar support surface for supporting the collection media;

at least one spinning electrode comprising a beaded chain having a linear segment adjacent the planar support surface, and another segment displaced a farther distance from the planar support surface than the linear segment;

a drive unit adapted to drive the spinning electrode, the linear segment maintaining a constant spacing from the planar support surface when driven by the drive unit;

a voltage source arranged to generate a voltage differential between the collection electrode and the spinning electrodes for spinning of fine fibers; and wherein the linear segment comprises a plurality of spinning locations separated by gaps.

7. The apparatus of claim 6, further including an entrance region and an exit region spaced apart along a first path, wherein the collection media is adapted to be driven along the first path and across the collection electrode from the entrance region to the exit region in spaced relation from the spinning electrode, and a dipping basin adapted to contain a polymer solution, wherein the spinning electrode is driven about an endless path with part of the spinning electrode running through the dipping basin for dipping into the polymer solution and thereby coating the spinning electrode with the polymer solution, and part of the spinning electrode being exposed for fine fiber generation.

8. The apparatus of claim 1, wherein the first electrode has a support surface for carrying the collection media.

9. The apparatus of claim 8, wherein the first electrode comprises a conductive perforated plate including a plurality of holes, the holes facilitating vacuum suction of the evaporated solvent through a ventilation hood system, wherein the collection media runs on the first electrode under a suction pressure.

10. The apparatus of claim 6, wherein the first electrode is formed of a conductive perforated plate including a plurality of holes, the holes facilitating vacuum suction of the evaporated solvent through a ventilation hood system, wherein the collection media runs on the first electrode under a suction pressure.

11. The apparatus of claim 1, wherein the first electrode and the second electrode are arranged to generate the fine fibers vertically such that the fine fibers travel vertically upward from the wetted strand toward the first electrode and are deposited on the collection media.

12. The apparatus of claim 6, wherein the collection electrode and the spinning electrodes are arranged to spin the fine fiber vertically, wherein the fine fibers travel vertically upward from the spinning electrode toward the collection electrode and deposited on the collection media.

13. The apparatus of claim 1, wherein the span of spinning locations is disposed below the first electrode at a first constant distance to uniformly deposit the fine fibers, and wherein the gaps between the spinning segments are disposed below the first electrode at a second constant distance, the second constant distance being greater than the first constant distance.

14. The apparatus of claim 13 wherein the spinning segments are coaxially aligned such that span of spinning locations are disposed below the first electrode in a linear arrangement.

15. The apparatus of claim 6, wherein the linear segment is arranged along a spinning path, and the other segment is arranged along a return path, the spinning path being disposed above the return path and below the planar support surface.

16. The apparatus of claim 15, wherein the spinning electrode moves in a first direction along the spinning path and a second direction opposite the first direction along the return path, wherein the first and second directions are generally parallel.

* * * * *